US010974280B2

(12) United States Patent
Kasper

(10) Patent No.: US 10,974,280 B2
(45) Date of Patent: Apr. 13, 2021

(54) ROCK SEPARATOR

(71) Applicant: Theodore Leonard Kasper, Pierz, MN (US)

(72) Inventor: Theodore Leonard Kasper, Pierz, MN (US)

( * ) Notice: Subject to any disclaimer, the term of this patent is extended or adjusted under 35 U.S.C. 154(b) by 168 days.

(21) Appl. No.: 15/796,207

(22) Filed: Oct. 27, 2017

(65) Prior Publication Data

US 2019/0091726 A1 Mar. 28, 2019

Related U.S. Application Data

(60) Provisional application No. 62/563,868, filed on Sep. 27, 2017.

(51) Int. Cl.

| | |
|---|---|
| ***B07B 1/46*** | (2006.01) |
| ***B07B 1/00*** | (2006.01) |
| ***B07B 1/18*** | (2006.01) |
| ***B07B 1/12*** | (2006.01) |

(52) U.S. Cl.

CPC ..... *B07B 1/4609* (2013.01); *B07B 1/005* (2013.01); *B07B 1/12* (2013.01); *B07B 1/18* (2013.01)

(58) Field of Classification Search

CPC ..... B07B 1/005; B07B 1/12; B07B 1/145; B07B 1/46; B07B 1/4609; B07B 13/07; B07B 2201/02

See application file for complete search history.

(56) References Cited

U.S. PATENT DOCUMENTS

| | | | | |
|---|---|---|---|---|
| 2,533,793 | A * | 12/1950 | Hamlett | A01D 25/04 171/12 |
| 5,002,656 | A * | 3/1991 | Johansson | B07B 1/22 209/421 |
| 6,092,606 | A * | 7/2000 | Basler | A01B 43/00 171/63 |
| 7,011,217 | B2 * | 3/2006 | Hanisch | B07B 1/12 209/319 |
| 8,534,371 | B2 * | 9/2013 | Roessler | A01B 43/00 171/63 |
| 8,708,154 | B1 * | 4/2014 | Holmberg | B07B 1/145 209/393 |
| 2008/0110807 | A1 * | 5/2008 | Goguen | B07B 1/12 209/394 |
| 2014/0291237 | A1 * | 10/2014 | Fulara | B07B 1/12 210/497.01 |
| 2016/0144299 | A1 * | 5/2016 | Mickelat | B07B 1/12 210/493.5 |

* cited by examiner

*Primary Examiner* — Charles A Fox
*Assistant Examiner* — Kalyanavenkateshware Kumar
(74) *Attorney, Agent, or Firm* — Brooks, Cameron & Huebsch, PLLC

(57) ABSTRACT

A rock separator for separating rocks from soil, where the rock separator includes a mounting plate a plurality of elongate tines secured to the mounting plate, where the plurality of elongate tines define a curved shape across the mounting plate, a plurality of support members laterally joining the plurality of elongate tines and an attachment bracket on the mounting plate for releasably mounting to a machine. The mounting plate has a first major surface and a second major surface opposite the first major surface. The attachment bracket is attached directly to the mounting plate, where the plurality of elongate tines do not move relative the attachment bracket.

16 Claims, 4 Drawing Sheets

ROCK SEPARATOR

This application claims priority to U.S. Provisional Application Ser. No. 62/563,868, filed Sep. 27, 2017, the contents of which are incorporated herein by reference in their entirety.

TECHNICAL FIELD

The present disclosure is related generally to equipment for separation, and more particularly to a separator for separating rocks from soil.

Figure 1:
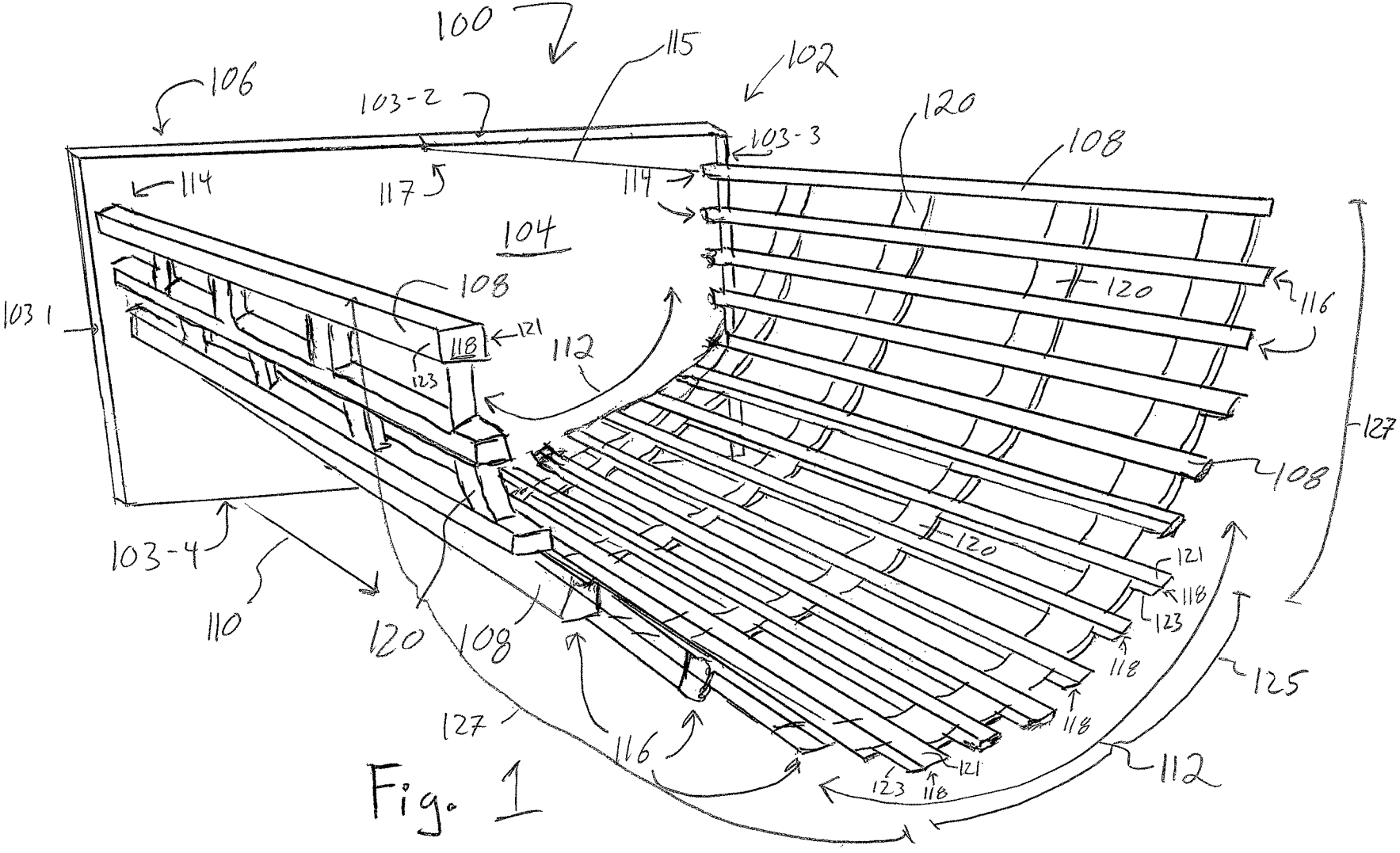
FIG. 1 is a perspective view of the rock separator according to one embodiment of the present disclosure.

The figures herein follow a numbering convention in which the first digit or digits correspond to the drawing figure number and the remaining two digits identify an element in the drawing. Similar elements between different figures may be identified by the use of similar digits. For example, 302 may reference element "02" in FIG. 3, and a similar element may be referenced as 402 in FIG. 4. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

DETAILED DESCRIPTION OF DISCLOSURE

The present disclosure is to a rock separator for separating rocks from soil. The rock separator is useful in the removal of rock from farm fields, among other applications. The advantages of the rock separator of the present disclosure are that it allows for the user to maintain high visibility of both the area in which the rock separator is being used along with the content (e.g., rocks) in the bucket of the separator. The bucket of the separator has a curved shape (or a semi-circular configuration) as discussed herein that keeps the rocks in the bucket while allowing the dirt and debris to fall through the tines, thereby separating the rocks from the soil. The curved shape also adds strength to the tines and to the end of the tine that engages the soil by supporting each tine in a number of directions. The curved shape of the bucket and the relative angle of the tines also helps to keep rocks from becoming lodged between the tines of the rock separator.

As used herein, "a," "an," "the," "at least one," and "one or more" are used interchangeably. The term "and/or" means one, one or more, or all of the listed items. The recitations of numerical ranges by endpoints include all numbers subsumed within that range (e.g., 1 to 5 includes 1, 1.5, 2, 2.75, 3, 3.80, 4, 5, etc.).

As used herein, welding is a fabrication process that fuses the metal parts described herein by any one of shielded metal arc welding, oxy-fuel welding, gas tungsten arc welding, gas metal arc welding or flux-cored arc welding, among others.

Referring now to FIG. 1, there is shown a perspective view of the rock separator 100 for separating rocks from soil according to the present disclosure. The rock separator 100 includes a mounting plate 102 having a first major surface 104 and a second major surface 106 opposite the first major surface 104. The rock separator 100 further includes a plurality of elongate tines 108 secured to the mounting plate 102, where each of the plurality of elongate tines 108 longitudinally extend in a common direction 110 away from both the first major surface 104 and the second major surface 106 of the mounting plate 102. The plurality of elongate tines 108 at the first major surface 104 define a curved shape 112 across the first major surface 104 of the mounting plate 102. The rock separator 100 further includes a plurality of support members 120 that laterally join the plurality of elongate tines 108. The rock separator 100 also includes an attachment bracket on the second major surface 106 of the mounting plate 102, where the attachment bracket can releasably mount to a machine (e.g., a skid loader, as discussed herein). Each of these elements of the rock separator is discussed more fully herein.

In one embodiment, the mounting plate 102 is planar having a rectangular cuboid configuration. The mounting plate 102 includes the first major surface 104, the second major surface 106 opposite the first major surface 104 and peripheral surface 103-1 through 103-4, which help to define the rectangular cuboid shape the mounting plate 102. As illustrated in FIG. 1, the mounting plate 102 can includes planar surface 103-1, 103-2, 103-3 and 103-4. Other shapes and configurations for the surfaces 103-1 through 103-4 are possible. The mounting plate 102 can be formed of a metal or metal alloy, such as steel or other iron based alloys.

In one embodiment, the mounting plate 102 can have a thickness of ⅜ to 2 inches; have a width (measured linearly from and perpendicular to planar surface 103-1 to 103-3) of 36 to 60 inches; and a height (measured linearly from and perpendicular to planar surface 103-2 to 103-4) of 12 to 36 inches. In one embodiment, the mounting plate 102 has a thickness of one half (½) of an inch; a width (measured linearly from and perpendicular to planar surface 103-1 to 103-3) of 48 inches; and a height (measured linearly from and perpendicular to planar surface 103-2 to planar surface 103-4) of 24 inches, where these dimensions help to keep the weight and stress of the rock separator 100 between the arms of the machine on which the rock separator 100 is releasably mounted (e.g., the skid loader).

Figure 2:
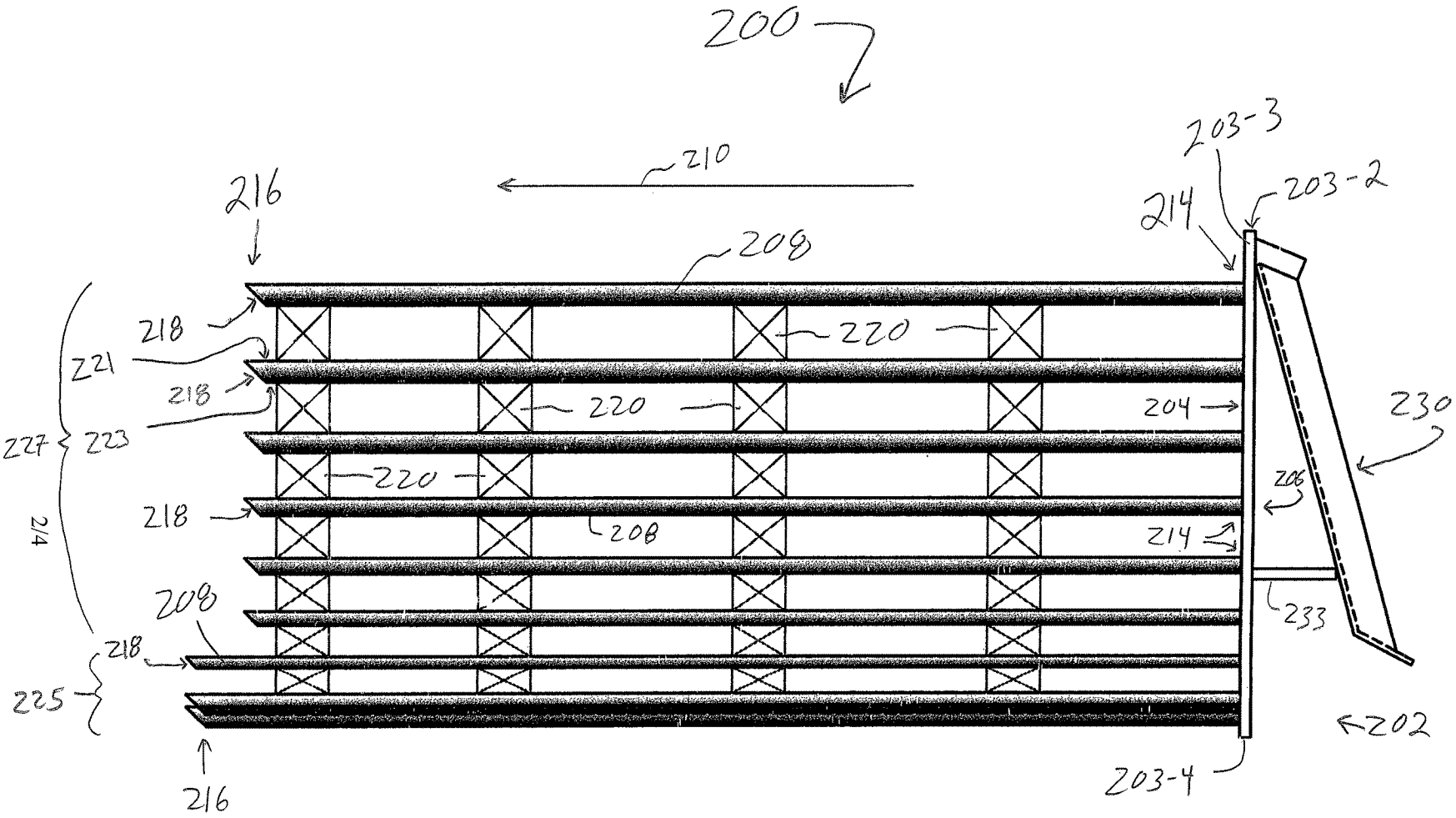
FIG. 2 is a side planar view of the rock separator according to one embodiment of the present disclosure.
Figure 4:
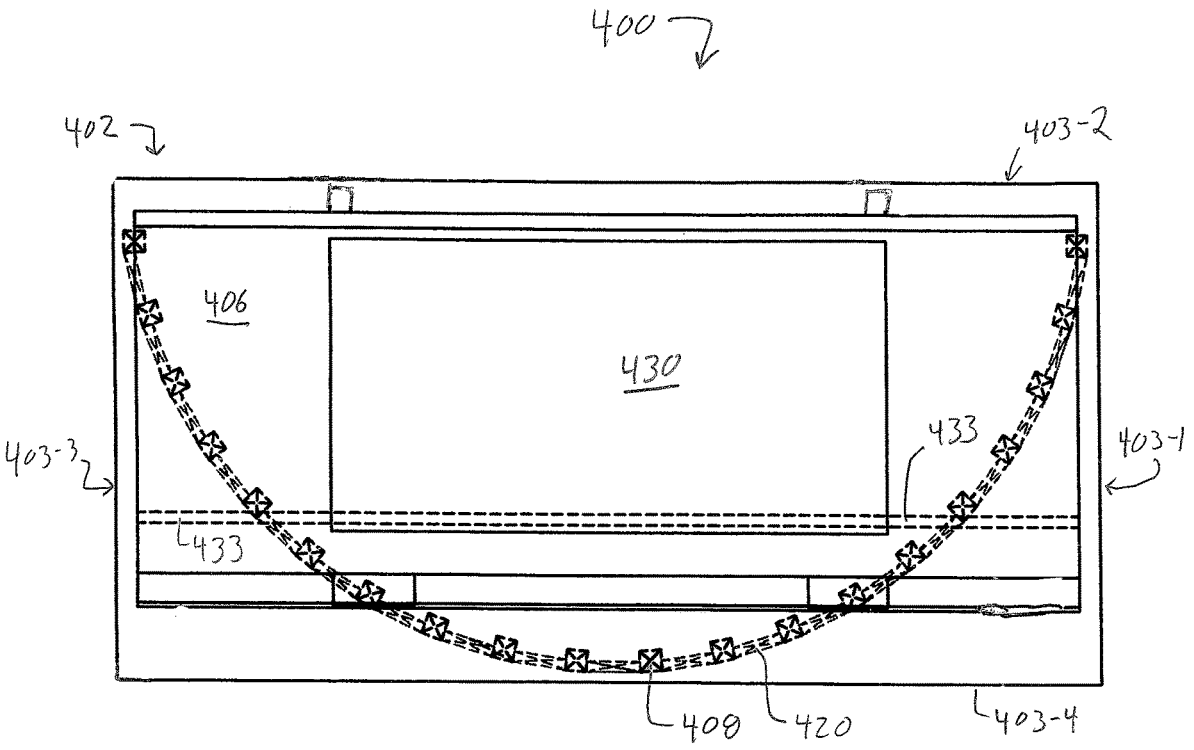
FIG. 4 is an end planar view of a second major surface of a mounting plate and an attachment bracket of the rock separator according to one embodiment of the present disclosure.

The mounting plate 102 also includes an attachment bracket on the second major surface 106 of the mounting plate 102, where the attachment bracket can releasably mounts to a machine (e.g., a skid loader). The attachment bracket is illustrated in FIGS. 2 and 4. Briefly, the attachment bracket provides a universal quick-attach coupling system for the rock separator 100, where the attachment bracket is attached closer to the planar surface 103-1 (the top planar surface) than the planar surface 103-4 (the bottom planar surface) to allow for the lower portions of the first major surface 104 and the second major surface 106 of the mounting plate 102 to be used to move soil like the blade of a bulldozer. For example, the placement of the attachment bracket can allow for the second major surface 106 of the mounting plate 102 to have 8 to 16 inches of the second major surface 106 below the bottom edge of the attachment bracket for use as a blade in moving soil (e.g., soil to fill in the holes created by removing rocks). As appreciated, the attachment bracket can be positioned higher or lower on the second major surface 106 of the mounting plate 102 as desired.

As discussed herein, the rock separator 100 includes a plurality of elongate tines 108 secured to the mounting plate 102, where each of the plurality of elongate tines 108 longitudinally extend in a common direction 110 away from both the first major surface 104 and the second major surface 106 of the mounting plate 102. FIG. 2 provides a planar side view of the rock separator 200 that helps to further illustrate both the plurality of elongate tines 208 and the attachment bracket 230 on the mounting plate 202.

Referring again to FIG. 1, the plurality of elongate tines 108 at the first major surface 104 define the curved shape 112 across the first major surface 104 of the mounting plate 102. This curved shape 112 helps to form the "bucket" or "container" that temporarily holds the rocks in the rock separator 100. As illustrated, however, the plurality of elongate tines 108 do not define a complete circular shape across the first major surface 104 of the mounting plate 102. In contrast, the plurality of elongate tines 108 at the first major surface 104 define a curve shape, such as a semi-circular shape across the first major surface 104 of the mounting plate 102. In one embodiment, the curve shape 112 formed by the plurality of elongate tines 108 has a radius of curvature 115 of 12 to 36 inches relative a center point 117 on the first major surface 104 of the mounting plate 102, where the center point 117 extends perpendicularly through and bisects the peripheral surface 103-2.

As illustrated in FIGS. 1 and 2, each of the plurality of elongate tines 108, 208 has a first end 114, 214 and a second end 116, 216. In one embodiment, the first end 114, 214 of each of the plurality of elongate tines 108, 208 is positioned against the first major surface 104, 204 of the mounting plate 102, 202. In one embodiment, the plurality of elongate tines 108, 208 are welded to the first major surface 104, 204 of the mounting plate 102, 202.

In one embodiment, the plurality of elongate tines 108, 208 have a square cross-sectional profile, where the side for the square can be from one-half to 2 inches. In one embodiment, the plurality of elongate tines 108, 208 have a 1-inch square cross-sectional profile. In an alternative embodiment, the plurality of elongate tines 108, 208 can have a circular (including oval) cross-sectional profile. The plurality of elongate tines 108, 208 can have other cross-sectional profile shapes, including, but not limited to, triangular or other polygonal cross-sectional profile shapes. The various cross-sectional profiles of the plurality of elongate tines 108, 208 can be either a solid cross-section or a hollow/tubular cross-section.

In one embodiment, the second end 116, 216 of each of the plurality of elongate tines 108, 208 is not parallel with the first major surface 104, 204 of the mounting plate 102, 202 which helps the plurality of elongate tines 108, 208 to penetrate the soil and scoop up rocks. For example, as illustrated in FIGS. 1 and 2, the plurality of elongate tines 108, 208 include an upper planar surface 121, 221 and a lower planar surface 123, 223, opposite the upper planar surface 121, 221. The second end 116, 216 of each of the plurality of elongate tines 108, 208 can be a planar surface having a 20 to 65 degree angle as measured between the upper planar surface 121, 221 and a planar surface 118, 218 (respectively) of the plurality of elongate tines 108, 208. Preferably, the surface 118, 218 of the plurality of elongate tines 108, 208 is shaped to have a 45 degree angle as measured between an upper planar surface 121, 221 and the planar surface 118, 218 (respectively) of the plurality of elongate tines 108, 208.

In an additional embodiment, the plurality of elongate tines 108, 208 are welded to the first major surface 104, 204 of the mounting plate 102, 202 such that the upper planar surface 121, 221 extends along and helps to define the curve shape 112, while allowing for the upper planar surface 121, 221 to be contacted by the rocks. In other words, the plurality of elongate tines 108, 208 are welded to the first major surface 104, 204 of the mounting plate 102, 202 so as to allow the upper planar surface 121, 221 of the plurality of elongate tines 108, 208 to help define the curve shape 112 and the volume of the bucket of the rock separator 100, 200 (e.g., the upper planar surface 121, 221 are not all parallel with the planar surfaces 103-2 and 103-4 of the mounting plate 102). This configuration helps to keep the surfaces of the tines "flat" to the rocks, which allows them to slide in more easily in the "bucket" of the rock separator 100, 200.

For the various embodiments, the plurality of elongate tines 108, 208 can have a longitudinal length of 36 inch to 54 inches, where a shorter length can help to add strength to the rock separator 100, 200 for use in heavier soils, or a longer length can be used to increase bucket capacity. In one embodiment, the plurality of elongate tines 108, 208 can have a common length. Alternatively, the plurality of elongate tines 108, 208 can have a first group 125, 225 of the plurality of elongate tines 108, 208 with a first length and a second group 127, 227 of the plurality of elongate tines 108, 208 with a second length, where the first length is greater than the second length. This embodiment is illustrated in FIGS. 1 and 2, where the first group 125, 225 of the plurality of elongate tines 108, 208 form a lower portion of the curved shape 112 across the first major surface 104, 204 of the mounting plate 102, 202, while the second group 127, 227 of the plurality of elongate tines 108, 208 form the upper portions of the curved shape 112.

The plurality of elongate tines 108, 208 can be formed of a metal or metal alloy, such as steel or other iron based alloys.

Referring again to FIGS. 1 and 2, the rock separator 100, 200 further includes a plurality of support members 120, 220 laterally joining the plurality of elongate tines 108, 208. The plurality of support members 120, 220 help to connect strengthen, support and maintain a specified space or gap between the plurality of elongate tines 108, 208. In one embodiment, the plurality of support members 120, 220 are positioned and welded between adjacent pairs of the plurality of elongate tines 108, 208. In one embodiment, the peripheral surfaces of the support members 120, 220 do not extend above either the upper planar surface 121, 221 or the lower planar surface 123, 223 of the plurality of elongate tines 108, 208. The plurality of support members 120, 220 help to add strength and support to the plurality of elongate tines 108, 208. For the various embodiments, the plurality of support members 120, 220 provide for a gap or space of 2 to 3 inches between adjacent pairs of the plurality of support members 120, 220. The plurality of support members 120, 220 can be welded along all eight edges or surfaces that contact the adjacent pairs of the plurality of support members 120, 220. Different size support member 120, 220 can be used to provide different size "gaps" between the adjacent pairs of the plurality of elongate tines 108, 208, where the different size gaps can be provided to accommodate different size rocks and help increase the strength of the rock separator 100, 200. For example, support members 120, 220 having a first size are used to join the elongate tines 108, 208 of the first group 125, 225, while support members 120, 220 having a second size larger than the first size are used to join the elongate tines 108, 208 of the second group 127, 227. This allow for smaller rocks that may drop to the bottom of the curved shape 112 to be captured in the rock separator while also providing additional strength for the longer tines (e.g., group 125, 225) that are the first to enter the soil while digging with the rock separator.

The plurality of support members 120, 220 can have a tubular or solid configuration, where when in the tubular configuration the wall thickness can be from 0.25 inches to 0.75 inches. The plurality of support members 120, 220 can have a rectangular, triangular or a circular cross-sectional shape, among others as discussed herein.

Figure 3:
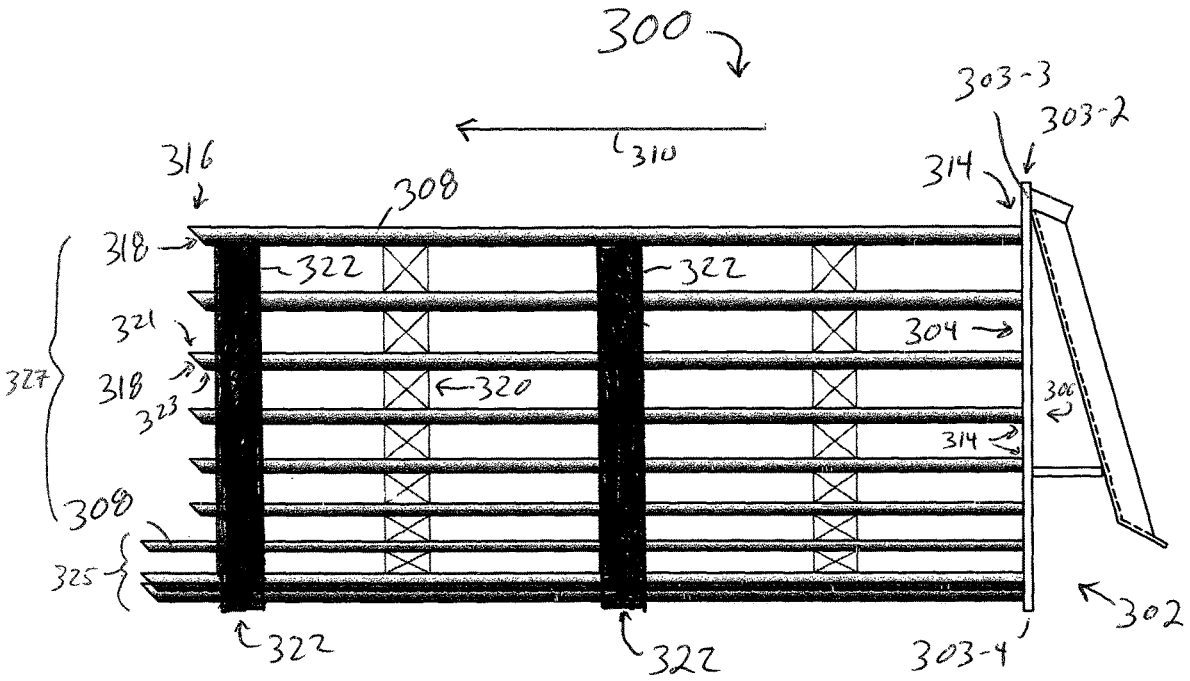
FIG. 3 is a side planar view of the rock separator according to one embodiment of the present disclosure.

In an alternative embodiment, FIG. 3 shows an embodiment in which at least one of the plurality of support members 320 is a continuous member 322 having a curved shape, where the continuous member 322 is positioned and secured (e.g., welded) to the lower planar surface 323 of the plurality of elongate tines 308. It is also possible to use a combination of both the continuous member as seen in FIG. 3 with the support members as seen in FIGS. 1 and 2 with the plurality of elongate tines, as seen in FIG. 3.

The plurality of support members 120, 220 and/or 320 can be positioned at uniform intervals from the first major surface 104, 204, 304 of the mounting plate 102, 204, 304. For example for tines that are between 48 and 54 inches, the plurality of support members 120, 220 and/or 320 can be positioned at 12 inch, 24 inch, 36 inch and 46 inches. Other spacing intervals for the plurality of support members 120, 220 and/or 320 from the first major surface 104, 204, 304 are also possible, but typically the support member 120, 220 and/or 320 furthest from the mounting plate 102, 204, 304 should be within 2 inch of the second end 116, 216, 316 of the pluraltiy of elongate tines 108, 208, 308.

The plurality of support members as discussed herein can be formed of a metal or metal alloy, such as steel or other iron based alloys.

The rock separator further includes an attachment bracket on the second major surface of the mounting plate. FIGS. 2 and 4 provide views of the rock separator 200, 400 with the attachment bracket 230, 430 on the second major surface 206, 406 of the mounting plate 202, 402. The attachment bracket 230, 430 can releasably mount the rock separator 200, 400 to a machine. Examples of such machines include a skid loader, a compact excavator, a backhoe loader or a front loader, among others. As appreciated, the attachment bracket 230, 430 releasably mounts to the loader-arms of the machine (e.g., the loader-arms of the skid loader). In addition, the rock separator can be scaled up or down to allow it to be releasably mounted to the machine. In one embodiment, the attachment bracket 230, 430 is attached directly to the second major surface 206, 406 of the mounting plate 202, 204. The plurality of elongate tines 208, 408 do not move relative the attachment bracket 230, 430.

The attachment bracket 230, 430 provides a universal quick-attach coupling system for the rock separator 200, 400, where the attachment bracket 230, 430 can be positioned closer to the planar surface 203-2, 403-2 (the top planar surface) than the planar surface 203-4, 403-4 (the bottom planar surface) to allow for the lower portions of the first major surface 204, 404 and the second major surface 206, 406 of the mounting plate 202, 402 to be used to move soil like the blade of a bulldozer. For example, the placement of the attachment bracket can allow for the second major surface 206, 406 of the mounting plate 202, 402 to have 8 to 16 inches of the second major surface 206, 406 below the bottom edge of the attachment bracket 230, 430 for use as a blade in moving soil (e.g., soil to fill in the holes created by removing rocks). As appreciated, the attachment bracket 230, 430 can be positioned higher or lower on the second major surface 206, 406 of the mounting plate 202, 402 as desired. The attachment bracket 230, 430 can be secured to the mounting plate 202, 402 through a welding process, as discussed herein. The attachment bracket 230, 430 can further include a spacer 233, 433 at the bottom of the attachment bracket 230, 430 that is 46 inch by 4 inch by ½ inch, which is welded flush with the bottom of the attachment bracket 230, 430 and welded to the second major surface 206, 406 at a 90 degree angle, 16 inch from the planar surface 203-2, 403-2 (the top planar surface) of the mounting plate 202, 402.

The attachment bracket as discussed herein can be formed of a metal or metal alloy, such as steel or other iron based alloys.

I claim:

1. A rock separator for separating rocks from soil, the rock separator comprising:

a mounting plate having a first major surface and a second major surface opposite the first major surface;

a plurality of elongate tines welded to the first major surface of the mounting plate and longitudinally extending in a common direction away from the first major surface of the mounting plate and wherein the plurality of elongate tines at the first major surface define a curved shape across the first major surface of the mounting plate;

a plurality of support members laterally joining the plurality of elongate tines; and an attachment bracket directly attached to the second major surface of the mounting plate, wherein the plurality of elongate tines do not move relative the attachment bracket and wherein the attachment bracket can releasably mount to a machine.

2. The rock separator of claim 1, wherein the mounting plate is planar.

3. The rock separator of claim 1, wherein the machine is a skid loader.

4. The rock separator of claim 1, wherein the plurality of support members are welded to the plurality of elongate tines.

5. The rock separator of claim 4, wherein the plurality of support members are positioned between the plurality of elongate tines.

6. The rock separator of claim 4, wherein at least one of the plurality of support members is a continuous member having a curved shape, wherein the continuous member is positioned on an outer surface of the plurality of elongate tines.

7. The rock separator of claim 1, wherein the plurality of elongate tines have a common length.

8. The rock separator of claim 1, wherein a first group of the plurality of elongate tines has a first length and a second group of the plurality of elongate tines has a second length, where the first length of the plurality of elongate tines is greater than the second length of the plurality of elongate tines.

9. The rock separator of claim 8, wherein the first group of the plurality of elongate tines form a lower portion of the curved shape across the first major surface of the mounting plate, while the second group of the plurality of elongate tines form upper portions of the curved shape.

10. The rock separator of claim 1, wherein each of the plurality of elongate tines has a first end and a second end, wherein the first end is positioned against the first major surface of the mounting plate.

11. The rock separator of claim 10, wherein the second end of each of the plurality of elongate tines is not parallel with the first major surface of the mounting plate.

12. The rock separator of claim 10, wherein the plurality of elongate tines include an upper planar surface and a lower planar surface, opposite the upper planar surface, wherein the second end of the plurality of elongate tines is a planar surface having a 20 to 65 degree angle as measured between the upper planar surface and the lower planar surface, opposite the upper planar surface, of the plurality of elongate tines.

13. The rock separator of claim 1, wherein the plurality of elongate tines do not define a complete circular shape across the first major surface of the mounting plate.

14. The rock separator of claim 1, wherein the plurality of elongate tines at the first major surface define a shape consisting of a semi-circular shape across the first major surface of the mounting plate.

15. The rock separator of claim 1, wherein the mounting plate, the plurality of elongate tines, the plurality of support members and the attachment bracket are formed from steel.

16. The rock separator of claim 1, wherein the plurality of elongate tines have a square cross-sectional profile.

* * * * *